United States Patent [19]

McDonald

[11] Patent Number: 4,649,366

[45] Date of Patent: Mar. 10, 1987

[54] TRIMMER CONTROL MOUNTED IN POTENTIOMETER KNOB

[75] Inventor: Gerald H. McDonald, Coon Rapids, Minn.

[73] Assignee: Resistance Technology, Inc., Minneapolis, Minn.

[21] Appl. No.: 784,332

[22] Filed: Oct. 4, 1985

[51] Int. Cl.[4] ..... H01C 10/16

[52] U.S. Cl. ..... 338/134; 338/152; 338/163

[58] Field of Search ..... 338/130, 131, 134, 152, 338/132, 163, 164, 184, 189

[56] References Cited

U.S. PATENT DOCUMENTS 2,881,295 4/1959 Brown ..... 338/134 X
4,453,152 6/1984 Dob et al. ..... 338/134 X

FOREIGN PATENT DOCUMENTS 216649 6/1924 United Kingdom ..... 338/134
218604 7/1924 United Kingdom ..... 338/134
251694 5/1926 United Kingdom ..... 338/134

*Primary Examiner*—Harold Broome
*Assistant Examiner*—M. M. Lateef
*Attorney, Agent, or Firm*—Kinney & Lange

[57] ABSTRACT

A trimmer control is mounted in a potentiometer knob to provide a compact controller for use in a device such as a hearing aid. The knob of the potentiometer is rotatably attached to a base housing which has a centrally located bore. A bracket extends through the bore of the housing and into a chamber located in the potentiometer knob. The bracket is fixedly attached at one end to the housing. The trimmer control is fixedly attached to the bracket and electrical leads of the trimmer control extend through a bore within the mounting bracket for connection with another circuit. The trimmer control is accessible through an opening in the potentiometer knob.

7 Claims, 2 Drawing Figures

TRIMMER CONTROL MOUNTED IN POTENTIOMETER KNOB

BACKGROUND OF THE INVENTION

1. Field of the Invention

The present invention relates to variable resistors, and in particular, it relates to a variable resistor mounted within another variable resistor to provide a compact controller for use in a device, such as a hearing aid.

2. Description of the Prior Art

Great efforts have been made to reduce the size of hearing aids. Two of the major components of a hearing aid include a potentiometer to control volume and a trimmer control to adjust low frequency. Each of these controls are variable resistors which have in the past been mounted separately within the hearing aid. Both controls have to be accessible to the user since they are used on a frequent basis to adjust the volume and the low frequency of the hearing aid. Typically, both controls are mounted on the outer surface of the hearing aid which requires valuable space.

The mounting of variable resistors in coaxial relationship is well known. The following patents provide examples of coaxially mounted variable resistors:

| Inventor | Patent No. |
|---|---|
| VanBenthuysen et al | 4,105,988 |
| Budd et al | 2,883,500 |
| Puerner | 3,918,022 |
| Matsui et al | 3,913,059 |
| Urwin | 3,697,921 |
| Kent | 3,597,717 |
| Matsui et al | 4,353,053 |

However, the above-listed patents describe arrangements which would not be practical or suitable for use in a device such as in a hearing aid.

SUMMARY OF THE INVENTION

The present invention includes positioning a trimmer control within a knob of a potentiometer. The knob is rotatably secured to a housing and moves a sliding contact member along a resistance element mounted within the housing. A mounting bracket made of a conductive material extends through a centrally located bore in the housing and extends into a chamber in the potentiometer knob. The bracket is fixedly attached to the housing at one end and is in rotational relationship with the potentiometer knob at another end. The trimmer control is fixedly attached to the bracket and disposed within the chamber of the knob. The trimmer control has conductive leads which extend through a bore within the bracket and out of the housing. The trimmer control includes a rotor which is accessible through an opening centrally located in the potentiometer knob such that the trimmer control is adjustable independently of the potentiometer. Similarly, the potentiometer knob is movable independently of the trimmer control.

DETAILED DESCRIPTION OF THE PREFERRED EMBODIMENTS

Figure 1:
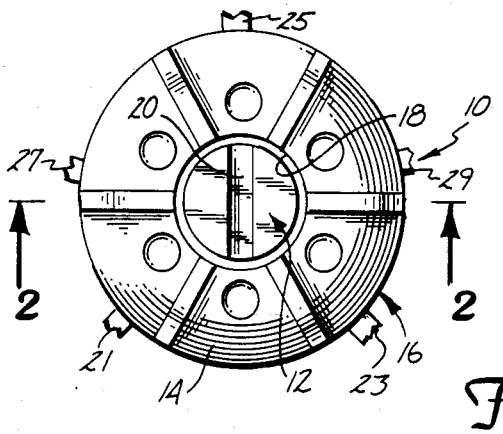
FIG. 1 is a top view of the trimmer control and potentiometer of the present invention.
Figure 2:
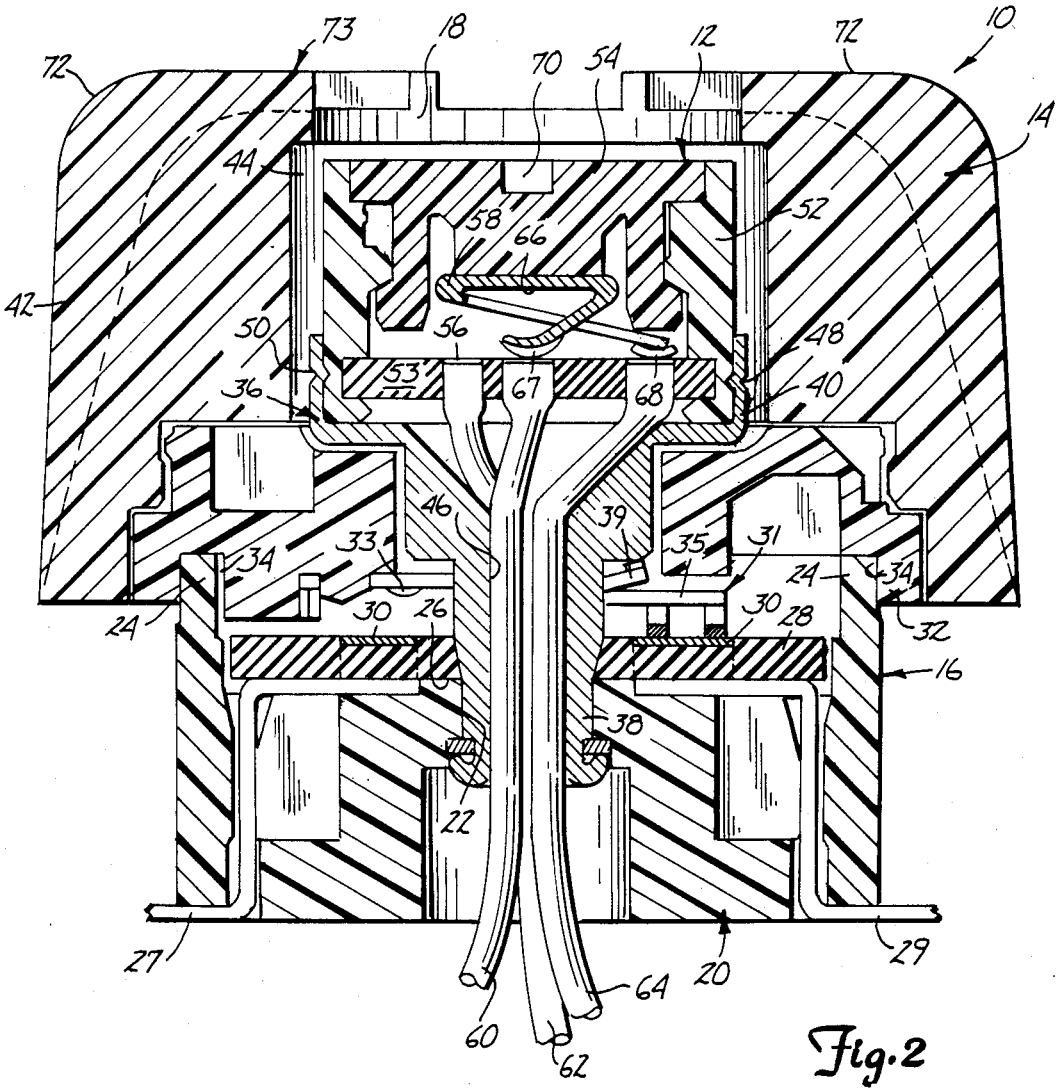
FIG. 2 is a cross sectional view taken along the line 2—2 in FIG. 1 with portions shown whole for clarity.

As illustrated in FIGS. 1 and 2, the present invention generally indicated at 10 includes a trimmer control 12 mounted within a knob member 14 of a potentiometer 16. The trimmer control 12 is accessible through an opening 18 in the potentiometer knob. The trimmer control 12 is operable independently of the potentiometer knob and the potentiometer knob 14 can be moved without affecting the trimmer control 12. Positioning the trimmer control 12 within the potentiometer knob 14 reduces space requirements, for example, as in a hearing aid in which the potentiometer is used as the volume control and the trimmer control is used to adjust low frequency.

As best illustrated in FIG. 2, the potentiometer 16 includes a housing 20 having a centrally located bore 22. The housing 20 is preferably molded of a nonconductive plastic material. The housing 20 includes an annular lip 24 defining a recessed surface 26 on which a plate 28 containing a resistance element 30 is mounted. A conductive wiper element 31 is attached at an end 33 to the knob member 14 and engages the resistance element 30 at another end 35. The potentiometer includes potentiometer leads 21, 23 and 25 and switch leads 27 and 29. The specific structure of the internal components of the potentiometer are not important to the present invention. A specific example of a suitable potentiometer is included in a patent application by Hagen entitled, "Compression Connection for Potentiometer Leads," assigned to the same assignee as the present application, filed on even date herewith and incorporated herein by reference.

The potentiometer knob 14 has an upper knob section 42 and a lower knob section 32. The lower knob section has an annular slot 34 which is in sliding engagement with the annular lip 24 of the housing. The upper knob section 42 is snapped onto the lower member 32 in a manner well known in snapping plastic components together. The upper section 42 and the lower section 32 define a chamber 44 in which the trimmer control is positioned.

A conductive mounting bracket 36 is used to hold and retain the trimmer control within the chamber 44. A portion 39 of the wiper element conductively engages the bracket 36 and the bracket is conductively connected to terminal 25. A lower portion 38 of the bracket extends through the bore 22 of the housing and an upper portion 40 extends into the chamber 44. The lower portion 38 is swaged so that the bracket is fixedly attached to the housing 20.

The upper portion 40 of the bracket 36 is of a cup-shaped configuration. The bracket 36 also includes a bore 46 that extends from the upper section 40 down through the lower section 38 communicating with a lower section of the bore 22 of the housing 20. The bracket is in conductive contact with an end 39 of the element 31.

The trimmer control 12 is positioned within the chamber 44 in the cup-shaped section 40. The trimmer control 12 includes an annular wall 52, a bottom wall 53, a rotor 54, a resistance element 56, a conductive slider 58 and insulated conductive leads 60, 62 and 64. The bottom wall 53 is fixedly attached to the annular wall 52. The resistance element 56 is positioned on the bottom wall 53 conductively connected to leads 62 and 64 while the wiper is conductively connected to lead 60.

The leads 60, 62 and 64 are positioned to extend through the bore 46 and out the housing 20 through the bore 22. The rotor 54 is rotatably secured to the housing 52. The slider 58 is fixedly attached to a lower end surface 66 of the rotor 54 and has an outer contact arm 67 and a center contact arm 68. As the rotor is moved, the outer contact arm 67 stays in a central position and the outer contact arm 68 moves along the resistance element 56. The rotor includes a slot 70 accessible through the opening 18 for engagement by a screw driver to move the rotor for adjusting the trimmer control.

The upper section 42 of the knob 14 includes a plurality of ridges 72 on an outer surface 73 to facilitate fingertip control of the potentiometer knob by the user.

In assembly, the potentiometer 16 is first assembled and the mounting bracket inserted through the bore 22 and swaged to the housing 20. The leads of the trimmer control 12 are then inserted through the bore 46 of the bracket 36 and the upper section 40 of the bracket crimped against the housing 52, as indicated by reference characters 48 and 50, to hold the trimmer control 12 in place. The section 42 is then snapped onto the lower section 32 to retain the entire potentiometer/-trimmer control assembly 10 together.

As will be appreciated by those skilled in the art, the potentiometer 16 is operable without affecting the setting of the trimmer control 12. In addition, the rotor 54 of the trimmer control 12 is moved without affecting the setting of the potentiometer by being accessible through the opening 18. A screw driver is used to engage the slot 70 and rotate the rotor 54 to move the slider 58.

In summary, the present invention provides an arrangement that reduces space requirements for potentiometer controls in devices such as hearing aids which require both a volume control and a trimmer to adjust low frequency. The combined potentiometer/trimmer arrangement is less than 0.25 inches in diameter, occupying much less space than previous arrangements. Although the potentiometer and trimmer are combined into one structure, the user of the hearing aid can still operate the volume control as in the prior art arrangements without affecting trimmer control adjustment.

Although the present invention has been described with reference to preferred embodiments, workers skilled in the art will recognize that changes may be made in form and detail without departing from the spirit and scope of the invention.

What is claimed is:

1. A device comprising:

a first variable resistor having a rotatable knob with a chamber located within the knob;

a second variable resistor disposed within the chamber;

means for anchoring the second variable resistor within the chamber such that the first and second variable resistors are adjustable independently of each other.

2. The device of claim 1 wherein the first variable resistor includes a housing and the means for anchoring the second variable resistor within the chamber includes a bracket fixedly attached to the housing and in rotational relationship with the knob of the first variable resistor.

3. The device of claim 1 wherein the second variable resistor is accessible through an opening in the knob of the first variable resistor.

4. The device of claim 3 wherein the second variable resistor includes a rotor and means for engaging the rotor, said means for engaging the rotor being accessible through the opening in the knob of the first variable resistor.

5. The device of claim 4 wherein the means for engaging the rotor is a slot within the rotor facing the opening of the first variable resistor knob.

6. A potentiometer/trimmer control assembly comprising:

a potentiometer including an insulating potentiometer housing having a first bore, a potentiometer knob being in rotational relationship with the housing and having a chamber in communication with the first bore and an opening, and means for varying potentiometer resistance through rotation of the knob;

a conductive mounting bracket disposed within the first bore of the housing and extending into the chamber of the knob, the bracket fixedly attached to the housing, and in rotational relationship with the knob, and in sliding conductive contact with the means for varying the resistance, the bracket having a second bore extending from the chamber and through the first bore; and a trimmer control having an insulating trimmer housing and a rotational member rotatably attached to the housing, means for varying trimmer resistance through rotation of the rotational member such that when the rotational member is moved, the resistance is varied, and first, second and third conductive leads in conductive contact with the means for varying trimmer resistance, said leads extending through the second bore in the bracket, and the trimmer housing being fixedly attached to the bracket and disposed within the chamber;

wherein the knob of the potentiometer is operable without affecting the setting of the trimmer control and the trimmer control rotor is accessible through the opening of the potentiometer knob and operable without affecting the setting of the potentiometer.

7. The assembly of claim 6 wherein the rotational member has a slot accessible through the opening in the knob of the potentiometer.

* * * * *